United States Patent [19]

Anders

[11] Patent Number: 4,878,539

[45] Date of Patent: Nov. 7, 1989

[54] METHOD AND SYSTEM FOR MAINTAINING AND PRODUCING HORIZONTAL WELL BORES

[75] Inventor: Edward O. Anders, Kerrville, Tex.

[73] Assignee: Anders Energy Corporation, Conroe, Tex.

[21] Appl. No.: 227,197

[22] Filed: Aug. 2, 1988

[51] Int. Cl.[4] ..... E21B 37/00; E21B 43/24; E21B 43/25

[52] U.S. Cl. ..... 166/303; 166/50; 166/52; 166/106; 166/312; 166/372

[58] Field of Search ..... 166/50, 105, 106, 67, 166/68, 303, 272, 306, 312, 305.1, 387, 372, 72

[56] References Cited

U.S. PATENT DOCUMENTS

| | | | |
|---|---|---|---|
| 1,492,042 | 2/1924 | McGee | 166/312 |
| 1,816,260 | 7/1931 | Lee | 166/303 |
| 2,857,002 | 10/1958 | Revere et al. | 166/303 |
| 2,974,937 | 3/1961 | Kiel | 166/272 |
| 3,064,729 | 11/1962 | Lindley | 166/297 |
| 3,172,470 | 3/1965 | Huitt et al. | 166/257 |
| 3,285,335 | 11/1966 | Reistle, Jr. | 166/252 |
| 3,338,306 | 3/1965 | Cook | 166/302 |
| 3,386,508 | 6/1968 | Bielstein et al. | 166/303 |
| 3,960,213 | 6/1976 | Striegler et al. | 166/272 |
| 4,022,279 | 5/1977 | Driver | 166/271 |
| 4,067,391 | 1/1978 | Dewell | 166/303 |
| 4,085,803 | 4/1978 | Butler | 166/303 |
| 4,116,275 | 9/1978 | Butler et al. | 166/50 X |
| 4,160,481 | 7/1979 | Turk et al. | 166/272 |
| 4,194,580 | 3/1980 | Messenger | 175/61 |
| 4,220,203 | 9/1980 | Steeman | 166/271 |
| 4,248,302 | 2/1981 | Churchman | 166/272 |
| 4,385,662 | 5/1983 | Mullins et al. | 166/50 X |
| 4,402,551 | 9/1983 | Wood et al. | 299/5 |
| 4,424,862 | 1/1984 | Munari et al. | 166/168 |
| 4,460,044 | 7/1984 | Porter | 166/50 X |
| 4,508,172 | 4/1985 | Mims et al. | 166/50 X |
| 4,574,884 | 3/1986 | Schmidt | 166/50 X |
| 4,598,770 | 7/1986 | Shu et al. | 166/50 X |
| 4,696,345 | 9/1987 | Hsueh | 166/50 X |

*Primary Examiner*—Stephen J. Novosad
*Attorney, Agent, or Firm*—Arnold, White & Durkee

[57] ABSTRACT

A system for conducting operations in a well penetrating laterally into a subsurface producing formation. The system employs two strings of tubing. One string extends from the surface throughout the well; the other string extends from the surface to a position generally above the lateral section of the well. Both strings pass through a dual packer installed above the formation.

35 Claims, 3 Drawing Sheets

METHOD AND SYSTEM FOR MAINTAINING AND PRODUCING HORIZONTAL WELL BORES

BACKGROUND OF THE INVENTION

1. Field of the Invention

The present invention pertains to the completion and operation of wells drilled laterally into underground formations. The invention, more especially, concerns a system of completing a horizontally disposed well in a producing formation in a manner which promotes production from the formation. The system also enables the well to be cleared of bridges and the like which may occur in the well. The invention has particular application to the production of oil and gas from subterranean formations.

2. Related Art

A continuing objective in the petroleum industry is to increase the productivity of wells drilled into petroleum-bearing formations. Another continuing objective is to minimize the need for expensive repair and workover operations caused by the occurrence of bridges and like in producing wells.

Once a well has been drilled into a petroleum bearing formation, it is a common practice to stimulate the well by hydraulic fracturing, acidizing, perforating, solvent treatments, and similar techniques. The general purpose of such techniques is to increase the effective permeability of the producing formation penetrated by the well. A related purpose is to increase the effective volume of the formation which is drained by the well. These purposes become especially important in instances where wells are very expensive to drill. This is particularly true, for example, in offshore locations where many wells may be drilled from a single offshore island or platform. It is a common practice in drilling such offshore wells to have them fan out laterally in many directions from the island or platform. These wells, therefore, will frequently extend in a generally horizontal direction into a formation.

The drilling of horizontally disposed wells is not limited to offshore locations. Wells of this nature are also drilled onshore. The more general practice onshore, however, is to drill vertical wells which extend down through the producing zone. Any sand, silt or other solids with a high density which may enter the well will then drop to the bottom "rat hole" portion of the well and cause no difficulties in producing the well. In this sense, vertical wells have had an advantage over horizontal or lateral wells in that the latter wells have been very subject to bridging The bridging material commonly consists of silt, formation particles, frac proppant, and the like.

Horizontal wells do not have a rat hole into which silt, sand and other particles may drop and accumulate. These materials, instead, accumulate along the lower side of such wells where they tend to raft up into barriers due to fluid flow. All too frequently, these barriers can completely close off the flow passage, in which case no production can be realized from behind the barriers.

SUMMARY OF THE INVENTION

The present invention springs in part from the realization that petroleum-bearing formations characteristically have naturally occurring vertical fractures, and that these fractures present the potential of producing from a substantially rectangular volume of a formation. By way of contrast, a vertical well drilled through such fractures results in production from a generally elliptical shaped volume whose major axis lies along the fractures, and whose minor axis is perpendicular to the fractures. It follows that the volume of a formation exposed to production is much greater in a horizontal or lateral well bore than a vertical well bore. It will be recognized, of course, that this condition prevails in those instances where the formation bedding planes are laterally disposed. It will further be recognized that this is generally the case in petroleum bearing formations.

The present invention is accordingly concerned with an improved system for completing horizontally disposed wells in petroleum bearing formations. The invention is especially concerned with a system which will reduce the adverse effects on such wells caused by bridging and the like. The invention is also concerned with a system for more effectively producing petroleum bearing formations.

To this end, the invention comprises a system in which two strings of tubing or similar conduits are installed in a well which includes a vertically disposed upper section and a laterally disposed lower section. A first string extends from the upper end of the well to the lower end of the well. This string is perforated near its lower end—i.e., near the distal end of the lateral section of the well. The second string extends from the upper end of the well to a point generally above the lateral section of the well. In a preferred form of the invention, a dual packer is installed in the vertical section of the well above a producing formation, zone or other interval of interest. The first tubing string passes through one passageway in the packer to terminate within the interval of interest. The second tubing string passes through the other passageway in the packer and normally terminates just below the packer.

Assuming the well to be equipped with a suitable pump, the pump is located in the vertical portion of the well above the packer. The pump is installed in the string of tubing which extends into the horizontal or lateral borehole to its far or distal end. As noted earlier, suitable perforations in the form of holes, slots or the like exist in this tubing proximate its distal end. Typically, the perforations will be located within a few feet or yards of the distal end of the tubing. The distal end of the tubing is closed. Formation fluids entering the horizontal section of the borehole must enter the tubing through the perforations and then through the tubing to the suction of the pump. From there, the pump may deliver the formation fluids up the well to the earth's surface. In the case where the pump is a rod-actuated pump, the fluids will normally flow up the first tubing string—i.e., the production string—to the surface. Alternatively, as in the case where the pump is a jet pump, the produced fluids may be pumped up the well annulus around a tubing string which delivers power fluid to the pump.

As noted earlier, a second string of tubing extends down the vertical portion of the well through the second passageway in the dual packer. In a preferred form of the invention, the second tubing string includes a landing nipple at the packer. This latter arrangement makes it possible to install a retrievable orifice or choke in the second tubing string. It is thereby also possible to select a controlled flow rate of fluid through the second tubing string while maintaining pump suction pressure in the horizontal well bore.

The foregoing type of well completion makes possible a variety of operations. A first such operation is directed at keeping the horizontal borehole free of bridges and the like. To that end, a small, normally regulated flow of clean crude or other oil is pumped down the second tubing string, and then through the horizontal borehole annulus into the far end of the first tubing string. From there the clean crude passes through the second tubing string to the downhole pump, whence it is pumped up to the surface of the earth. If a bridge develops in the horizontal well bore, the level of clean oil in the second tubing string automatically begins to rise and build up pressure in this string. By proper selection of the clean oil flow rate and the diameter of the second string, the pressure in this string will build up quickly to the pressure in the producing formation. However, the pressure will continue to rise if the bridge does not break at that point. As a consequence the bridge will almost surely break, because very high differential pressures (between pressures in the second string and the suction pressure below the downhole pump) become available. Moreover, additional pressure beyond the head pressure in the second tubing string can be exerted by increasing the flow rate of the pump at the earth's surface which delivers clean oil to the second string.

In accordance with an alternate embodiment of the invention, an orifice in the second tubing string may be installed at the entrance to the string at the earth's surface rather than at the dual packer. Bridging will now cause the hydrostatic head in the second string to build up as before; however, when the bridge breaks, clean oil flow will not be restricted until the hydrostatic head in the second string has been depleted.

In accordance with another alternate embodiment of the invention, the dual packer may be omitted in which case clean crude may be permitted to build up in the well as far as the earth's surface. This embodiment, however, lacks the control provided by the packer and retrievable choke.

In accordance with still another embodiment of the invention, various fluids may be injected down the second (smaller) tubing string for the purpose of stimulating production from the formation penetrated by the horizontal well. Thus, production from the well can be shut in while a fluid such as carbon dioxide, liquefied propane, hot water, steam or the like is injected down the second string and into the formation. After sufficient fluid has been injected to soak, or otherwise mix with, formation fluids surrounding the well, the well can be placed on production again with attendant increased flow of formation fluids from the well.

In instances where more than one well has been completed in a given formation, the invention may be used to advantage in producing formation fluids from one well to another. Thus, assuming two laterally spaced wells completed in accordance with the present invention, an oil displacing fluid such as thickened water can be injected down the small tubing string in one well and then forced toward the adjacent well by restricting production from the original well in favor of production from the adjacent well. Further, various flow patterns may be established between the wells, such that improved sweep between the wells may be obtained.

In considering all of the above producing operations, it is important to recognize that the presence of natural vertical fractures in a formation greatly favors increased production. As explained earlier, the combination of a horizontally drilled well and vertical fractures is a highly beneficial one in making for better production rates.

The present invention also contemplates the placement of gravel, resin coated sand and similar packing in the horizontally disposed annulus between the walls of a horizontally drilled well and a length of perforated tubing within the well. Placement of such materials can be attained by pumping them down the second tubing string and into the annulus to be deposited in the annulus. If a small diameter, retrievable orifice is present in the second string through the dual packer, this orifice may be removed prior to pumping the placement material down the well.

In those instances where gas locking of the down hole pump may occur because of low formation pressure or high gas/oil ratios of the fluids produced, etc., it is contemplated that locking may be readily overcome by venting the well through the second tubing string.

DESCRIPTION OF THE PREFERRED EMBODIMENT

Figure 1:
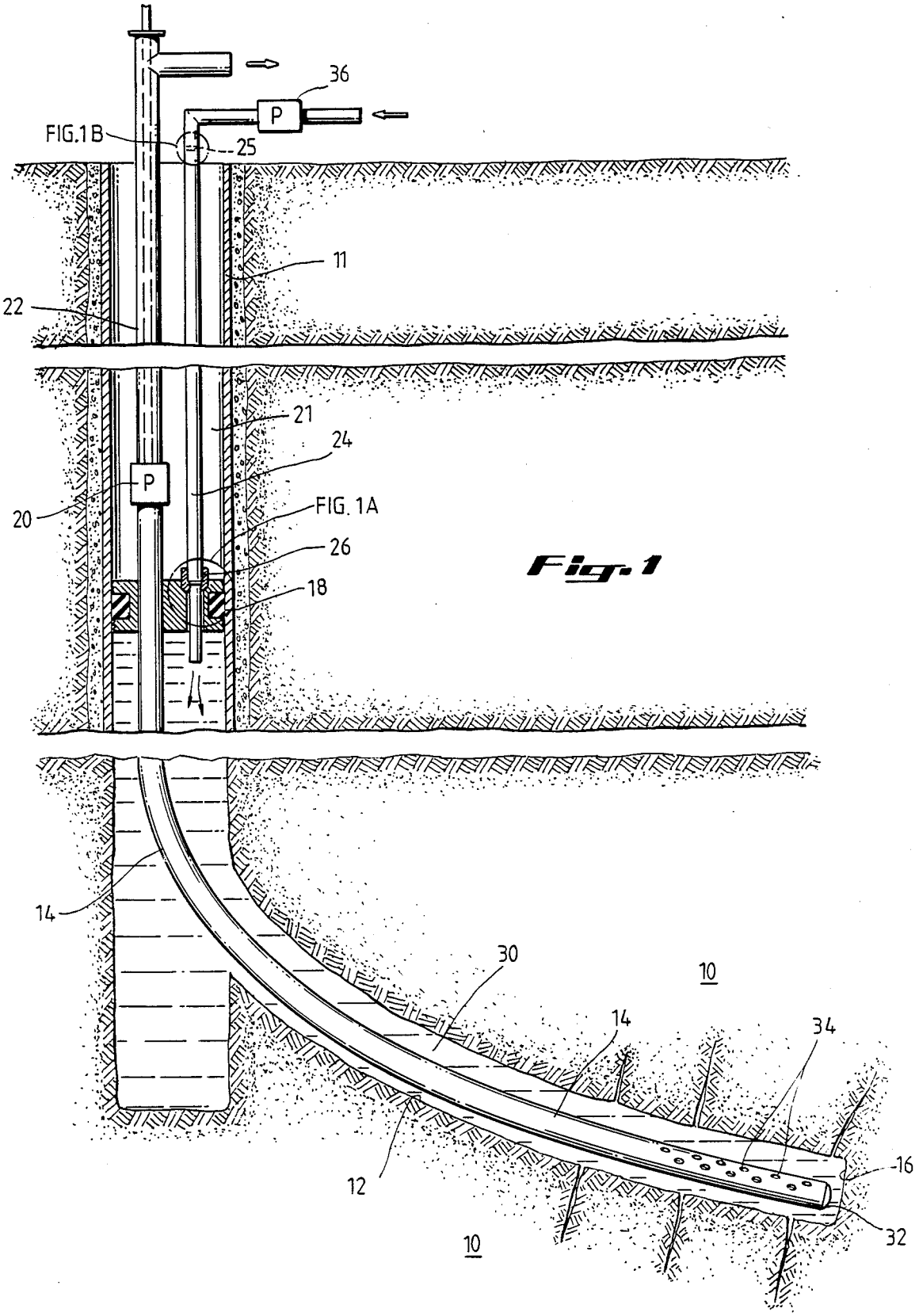
FIG. 1 illustrates in partial vertical section how the invention may be applied to an existing vertical well.

Referring to FIG. 1, a horizontally disposed well section or borehole 12 has been formed in producing zone, formation or other interval 10 from a vertically disposed well section 8. Casing 11 extends down the vertical well 8 to a point somewhat above the lateral section 12. A dual packer 18 is set within the casing 11, and two strings of tubing 14 and 24 extend through the dual passages in the packer. The larger tubing string 14 extends from a down hole pump 20 above the packer 18 to the remote or distal end 16 of the well 12. The tubing string 14 is perforated by perforations 34 proximate its closed distal end 32.

The second tubing string 24, normally smaller in diameter than string 14, extends from a pump 36 at the surface of the earth down through the second passageway in the packer 18. A landing nipple 26 is installed in this packer passageway such that removable orifices of different sizes may be placed in the second tubing string.

A tubing string 22 extends up the well 8 from the pump 20 to the surface of the earth. This tubing string and tubing string 14 constitute, in effect, a single string 14 through which pump 20 takes suction and delivers produced fluids up the well to the surface. A wellhead ss not shown at the top of the well 8; however, it will be recognized that the selection of a suitable wellhead is within the state of the art.

The pump 20 shown in the drawing is typically a downhole rod-actuated pump, although a jet pump may also be used as explained earlier in this description. In the latter case, a jet pump would normally discharge fluid into the annulus 21 and thence o the earth's surface.

In operation, the system shown in FIG. 1 enables fluids in the producing formation 10 to flow into the annulus 30, from which the fluids flow through the perforations 34 into the tubing 14. The fluids then flow through the pump 20 to the earth's surface. Flow of the fluids is promoted by virtue of the fact that the well 12 is substantially normal to vertical microfractures which commonly prevail in deep producing structures. The well 12 is preferably substantially parallel to the bedding planes of the formation 10; in the drawing, the bedding planes have been assumed to be substantially horizontal.

Concomitant with the production of fluids from the formation 10, a clean oil or oil fraction is pumped slowly down the tubing 24 from which it, too, ultimately discharges into the annulus 30. Conveniently, the clean oil may be produced crude from which water and sediment have been removed. Then, together with the formation fluids, it flows through the perforations 24 to the pump 20 and the earth's surface. The actual flow of the clean oil will normally be small in relation to the flow of the formation fluids; and it may typically be about five barrels per day. Even at such a flow rate, however, the head of clean oil in the tubing 24 can be expected to rise rapidly. Moreover, the head can be increased even more rapidly by increasing the pumping rate of the pump 36. In any case, the head of clean oil will exert itself against any bridge or other blockage which may occur in the lateral well section 12. It is contemplated to be almost a certainty that such breakage will occur, taking into account the available combinations of column head pressure and pump pressure. Moreover, when such breakage takes place, large particles of rock or other solids may be prevented from reaching the pump 20 by properly sizing the perforations 34. In one actual operation, perforations in the form of slots about 1/16-inch wide and about four inches long were found to be quite effective for this purpose.

Figure 1A:
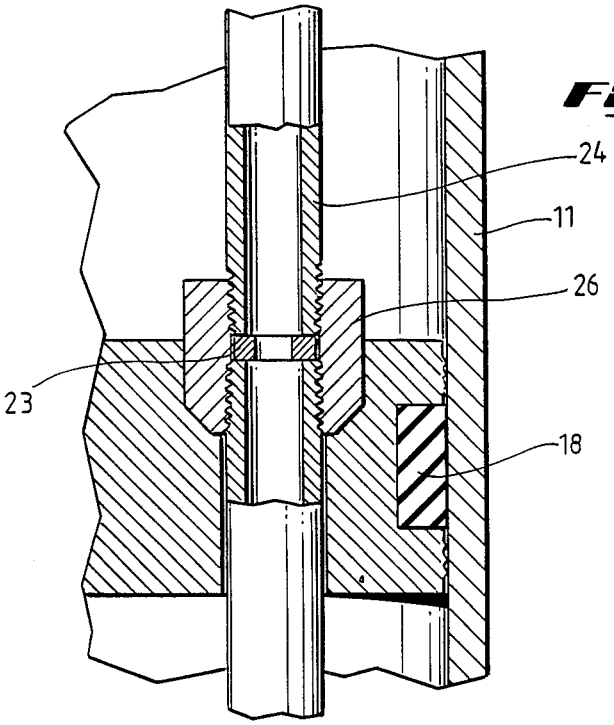
FIG. 1A, is an enlarged detail view in longitudinal cross-section of a landing nipple and orifice located at the dual packer.
Figure 1B:
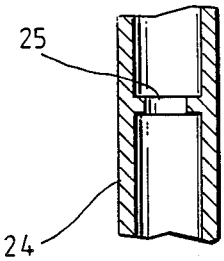
FIG. 1B, is an enlarged, detail view in section of an orifice located in the spaghetti string at the earth's surface.

It will be apparent that the structure and operation of the system shown in the drawing may be modified or altered as desired. For example, the flow rate of clean oil down the tubing 24 may be adjusted by changing the size of an orifice 23 (as in FIG. 1A) in the landing nipple 26, or by installing the orifice 25 in the tubing 24 at the earth's surface. By using the orifice 25 in the latter position, flow of clean oil from the tubing 24 will be substantially unrestricted, once a bridge has been broken, until the hydrostatic head in the tubing 24 has been depleted.

If desired, gravel or other materials may be placed in the well 12 to mitigate or control bridging. Especially contemplated, for example, is the use of resin-coated particles that bond together at their surfaces to form a permeable annular plug which helps to stabilize a well bore. Typical particles of this nature are epoxy-coated sand particles, wherein the epoxy coating is thermal setting at the temperature prevailing with the section of a well in which they are to be located. In any case, it will be recognized that placement of such particles, gravel or the like would be preceded by removing any orifice in the tubing string 24. The tubing strings 14 and 22 would also be open to the surface during such placement.

It is also feasible, when so desired, to use the tubing string 24 to pump fluids from the proximal or near end of the horizontal hole 12. In this embodiment, any orifice plate in the nipple 26 would be removed, and a downhole pump installed in the tubing string 24.

Wells with low formation pressure and high gas/oil ratios can be difficult to produce because of gas locking of the pump. It is a feature of the invention that the small tubing string 24 can be opened at the surface to allow gas to vent and thereby deal with the gas locking problem.

As noted earlier, the embodiment of the invention shown in FIG. 1 depicts how the invention may be applied to an existing vertically disposed well. It will be apparent that entirely new wells may also be drilled for use of the invention. Thus, such a well may comprise a single borehole which starts in a vertical orientation at the earth's surface and at a selected depth gradually curves to a lateral orientation. The latter orientation is preferably parallel to the bedding planes of the earth interval into which it extends.

As will be evident, the system of FIG. 1 is readily suited for injecting various gases and other fluids for enhanced recoveries or other purposes. Thus, carbon dioxide, steam or the like may be injected down the tubing string 24 and forced into the formation 10 for an extended period of time while the well is shut in. Upon re-opening the well, it is known that greatly increased oil production rates normally follow. These greater rates are especially characteristic when wells lying along the bedding planes intercept fractures generally normal to the bedding planes.

Production of formation fluids from two or more laterally spaced wells completed according to the invention in a producing formation is also contemplated. Thus, thickened water, solvents, carbon dioxide, steam, etc. may be injected down the tubing 24 in a given well and directed toward a spaced well by adjusting flow up the tubing 22 in the given well. Assuming that the spaced well is completed in the same general manner as the given well, the fluids produced there may enter through the perforations 34 into the tubing 14 and then flow up this tubing to the earth's surface.

Figure 2:
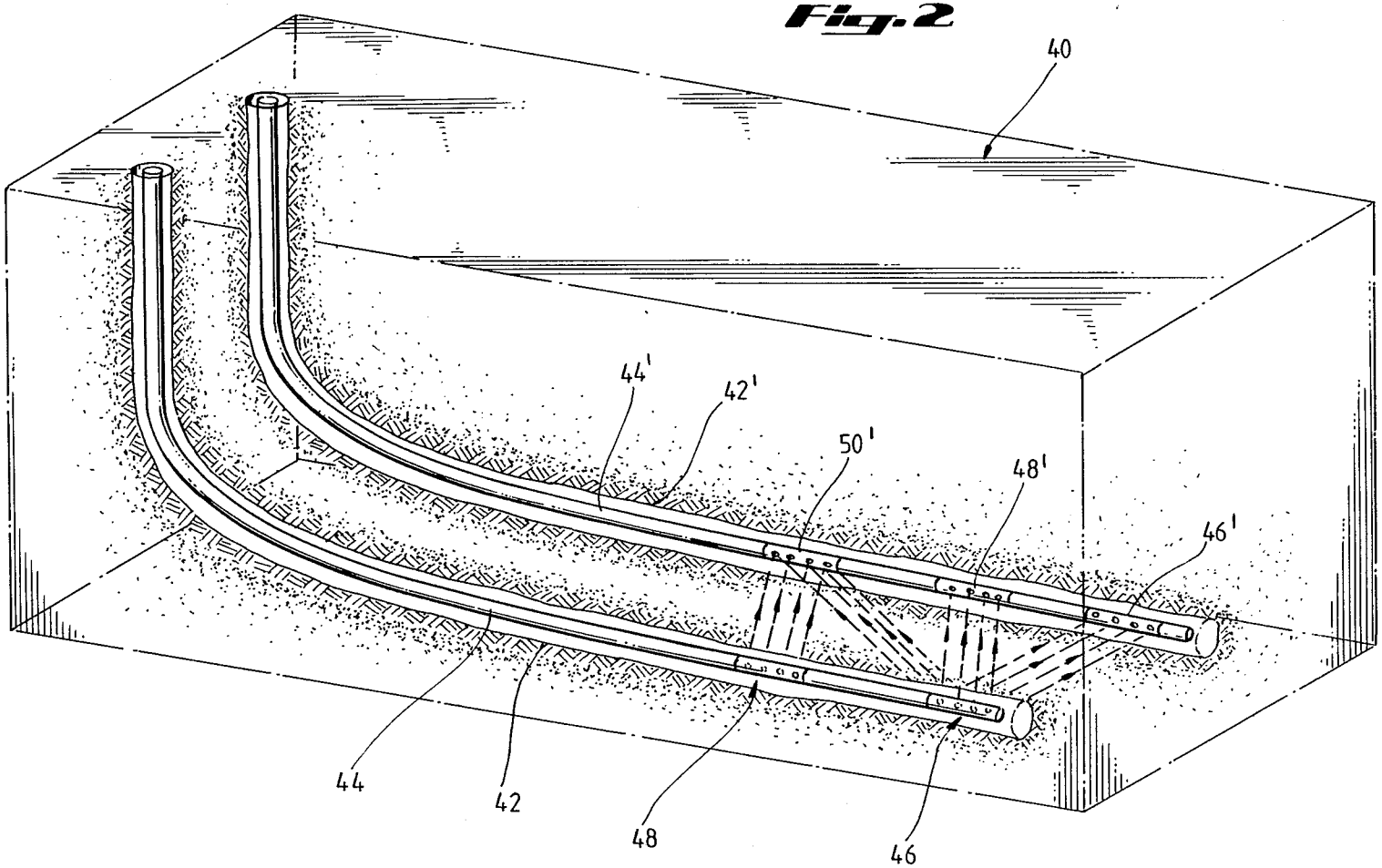

FIG. 2 illustrates how the system of the invention may be applied to a reservoir in an enhanced recovery operation to improve sweep of the reservoir. In FIG. 2 a three-dimensional portion or block 40 of a producing interval is penetrated by two laterally spaced and laterally disposed wells 42 and 42'. Both of the wells may be completed in the same general manner as the well shown in FIG. 1, especially where there is a danger of bridging occurring in either well or where both wells may be used as producing wells. Alternatively, if well 42 is to be used solely as an injection well and well 42' solely as a producing well, the completion system used in well 42 may be simplified by eliminating the second tubing string 24, the downhole pump 20, and the packer 18. In any case, water, steam, solvents, hot water, gas or other drive fluids may be passed down the well 42 and thence into the interval 40 so as to displace oil into the well 42'.

It will be apparent from FIG. 1 that a displacing or drive fluid may simply pass down the tubing string 24 and thence into the formation 10 all along the wall of the lateral borehole section 12. Flow up the tubing 14 would be closed off or restricted. Assuming this to be the case in FIG. 2, oil and other fluids in the interval 40 will be displaced toward and along the lateral borehole 42'. This relatively simple type of operation, however, does not take full advantage of the invention. Thus, in a preferred operation, a flow pattern or series of flow patterns may be established between wells 42 and 42' to improve sweep efficiency between the wells. Thus, referring first to well 42, this well may be completed such that a drive fluid is passed down the tubing 44 and out through a distal set of perforations 46 into the interval 40. To assure this direction of flow, a packer may be set above the perforations 46 corresponding to the perforations 34 in FIG. 1. Alternatively, the annulus around the tubing 44 may be cemented, and the perforations 46 may extend through both the tubing 44 and the surrounding cement.

Referring to well 42' in FIG. 2, the tubing 44' may be perforated initially only at the position 46' near the distal end of the borehole 42'. Fluid flow through interval 40 will then tend to be limited to the portion of interval 40 between these two sets of perforations. Cement may be placed in the annulus in the well 44' and perforated at position 46' to further promote this flow pattern.

Once the displacement of reservoir fluid between the perforations 46 and 46' has been carried out to an economic or other desired limit, a new flow pattern may be established in the interval 40. For example, a new set of perforations 48' may be formed in well 42', and a flow pattern established between perforations 46 and 48' To further promote this pattern, the perforations 46' may be closed off; and prior to such closure, thickened water may be injected between perforations 46 and 46' to decrease the mobility of the drive fluid through this region.

The flow pattern between the perforations 46 and 48' may then be practiced until a new economic or other limit is reached. At this point, another new flow pattern may be established — as for example, between perforations 48 and 48', or between 46 and 50', or between 48 and 50'. It will be apparent, of course, that the same general techniques used to establish the flow pattern between perforations 46 and 48' may be used to ensure a selective flow pattern for each subsequent flow pattern in a sequence of flow patterns.

The foregoing description has been directed at a petroleum recovery operation. It will be recognized, however, that aspects of the invention may have application to the recovery of other mineral values from intervals in the earth. This is especially the case where the mineral values exist in vertically fractured structures which are prone to pass silt and the like so as to bridge lateral well bores. The mineral values, in general, would be minerals capable of being flowed, leached or thermally stimulated. Tar or bitumen in bituminous tar sands is an example of such values.

What is claimed is:

1. A method of operating a well in a generally horizontal, petroleum-bearing subsurface formation, said well including a generally horizontal section extending into the formation and a generally vertical section extending to the earth's surface, comprising:

running a first tubing string down the well and substantially into the generally horizontal section;

running a second tubing string down the well to terminate above the generally horizontal section;

packing off the first and second tubing strings above the generally horizontal section;

producing petroleum from the formation into the annulus between the first tubing string and the wall of the generally horizontal section and thence into and through the first tubing string; and flowing a clean petroleum liquid down the second tubing string.

2. Apparatus for completing a well in a subsurface oil bearing formation, the well including a lower, generally horizontal section which extends into the formation; which comprises:

a dual packer set in the well above the formation;

a first tubing string extending down through a first passageway in the packer and substantially into the generally horizontal section in the formation; said first tubing string being closed at its lower distal end and defining a plurality of perforations proximate the distal end;

a pump in the first tubing string above the packer operable to pump liquid up the well; and a second tubing string extending from the earth's surface down the well through a second passageway in the packer and terminating below the packer.

3. The apparatus of claim 2 which further comprises a landing nipple in the second tubing string at the packer.

4. Apparatus for completing a well in a subsurface petroleum bearing formation wherein the well has a generally vertical upper section, and a generally horizontal lower section which extends into the formation which comprises:

a dual packer positioned in the well above the generally horizontal section;

a first tubing string extending from the earth's surface down through a first passageway in the packer and then to a remote preselected point in the formation, the first tubing string being closed at its lower end and perforated near its lower end;

a pump in the first tubing string above the packer capable of pumping fluid up the well to the earth's surface; and a second tubing string extending from the earth's surface down through a second passageway in the dual packer to terminate proximate the packer.

5. The apparatus of claim 4 further comprising a pump in the second tubing string above the packer capable of pumping liquid down the well.

6. The apparatus of claim 4 further comprising a landing nipple in the second tubing string adapted to land a retrievable orifice.

7. The apparatus of claim 6 further comprising an orifice in the second tubing string at the landing nipple.

8. A well completion for a well penetrating a petroleum-bearing subsurface interval, wherein the well includes a generally horizontal section extending into the interval and a generally vertical section extending upward from the generally horizontal section, which comprises:

a dual passageway packer positioned in the well above the generally horizontal section;

a downhole pump in the well above the packer capable of pumping liquid up the well;

a first conduit extending from the suction side of the pump through a first passageway in the dual packer into the generally horizontal section to define an annular space with the wall surface of the generally horizontal section, the first conduit being closed at its distal end and perforated proximate its distal end;

a second conduit extending from the pump up the generally vertical well section; and a third conduit extending down the well through a second passageway in the dual packer.

9. The well completion of claim 8 which further comprises an orifice in the third conduit.

10. The well completion of claim 9 in which the orifice is at the packer.

11. The well completion of claim 9 in which the orifice is at the top of the well.

12. The well completion of claim 8 wherein the downhole pump is a rod-actuated pump and the second conduct extends from the discharge of the pump up the well.

13. The well completion of claim 8 wherein the downhole pump is a jet pump, the second conduct is adapted to supply power fluid down the generally vertical section to the jet pump, and the discharge of the pump discharges into the generally vertical section.

14. The well completion of claim 8 which further comprises a landing nipple in the third conduit at the packer and capable of landing a retrievable orifice.

15. The well completion of claim 14 further comprising a retrievable orifice landed in the landing nipple.

16. The well completion of claim 8 further comprising an uphole pump at the top of the well connected to the third conduit to pump liquid down the well.

17. A method of recovering oil from a subsurface oil-bearing formation by means of a well which has a vertically disposed well section extending down from the surface of the earth, and a laterally disposed well section which extends into the formation generally along the bedding planes of the formation to a distal end within the formation, comprising:

transmitting oil produced from the formation into the laterally disposed section from the distal end of the laterally disposed section through a first separate fixed passageway extending from the distal end of the laterally disposed section to the earth's surface; and transmitting fluid down a second separate fluid passageway from the earth's surface to a point above the laterally disposed section.

18. The method of claim 17 in which the fluid is recovered oil.

19. The method of claim 18 in which the fluid is recovered oil which has been treated to remove sediment.

20. The method of claim 17 in which the fluid is steam or hot water.

21. The method of claim 20 in which the transmittal of oil through the first fluid passageway is restricted during at least a portion of the time that hot water or steam is transmitted down the second passageway.

22. The method of claim 17 which further comprises injecting an oil-displacing fluid into the oil-bearing formation toward the laterally disposed well section from a second laterally disposed well section which is spaced from the first-named laterally disposed well section.

23. The method of claim 22 in which the second laterally disposed well section is spaced laterally from the first-named laterally disposed well section.

24. The method of claim 22 in which the second laterally disposed well section is spaced vertically from the first-named laterally disposed well section.

25. Apparatus for producing oil from a subsurface oil-bearing interval, which comprises:

a laterally disposed well section which extends from a proximal end to a distal end within the subsurface, oil-bearing interval;

a vertically disposed well section which extends from said proximal end to the earth's surface;

a first conduit within said laterally disposed section extending from a distal end within the laterally disposed section to a proximal end within the vertically disposed section said first conduit being closed at its distal end and defining a plurality of perforations proximate its distal end;

a second conduit disposed within the vertically disposed section configured to receive fluid from the proxemal end of the first conduit and to convey such fluid to the earth's surface; and a third conduit disposed within the vertically disposed section capable of conveying fluid from the surface of the earth down the vertically disposed section.

26. The apparatus of claim 25 which further comprises a downhole pump arranged to take suction from the proximal end of the first conduit and to discharge into the second conduit.

27. The apparatus of claim 26 in which the vertically disposed well section is cased, a dual packer is positioned within the vertically disposed well section below the downhole pump, the first conduit passes through a first passageway in the packer, and the third conduit passes through a second passageway in the dual packer.

28. The apparatus of claim 27 in which the downhole pump is a rod-actuated pump.

29. The apparatus of claim 27 which further comprises an orifice in the third conduit.

30. The apparatus of claim 29 in which the orifice is positioned at the dual packer.

31. The apparatus of claim 29 in which the orifice is positioned proximate the earth's surface.

32. The apparatus of claim 26 which the vertically disposed well section is cased and the second conduit comprises the well casing; the pump is a jet pump; a dual packer is positioned in the vertically disposed well section below the downhole pump; the first conduit passes through a first passageway in the packer; and the third conduit is adapted to convey a power fluid to the jet pump.

33. The apparatus of claim 25 further comprising a packing material within the annular space between the first conduit and the laterally disposed well section.

34. The apparatus of claim 25 which further comprises:

a second laterally disposed well section which is spaced from the first laterally disposed well section, and which extends from a proximal end to a distal end within the subsurface interval;

a second vertically disposed well section which is spaced from the first vertically disposed well section, and which extends from the proximal end of the secondlaterally disposed well section to the earth's surface; and a fourth conduit disposed within the second vertically disposed well section to convey fluid from the earth's surface to the second laterally disposed well section.

35. The apparatus of claim 34 in which the fourth conduit extends at its distal end into the second laterally disposed well section and said fourth conduit is closed at its distal end and defines at least one set of perforations within said second laterally disposed well section.

* * * * *

UNITED STATES PATENT AND TRADEMARK OFFICE

CERTIFICATE OF CORRECTION

PATENT NO. : 4,878,539

DATED : November 7, 1989

INVENTOR(S) : Edward O. Anders

It is certified that error appears in the above-identified patent and that said Letters Patent is hereby corrected as shown below:

Column 7, line 51, before "to" insert --upward--.
line 61, "flowing" begins new paragraph.
Column 9, line 3, delete "conduct" and insert therefor --conduit--.
Column 10, line 23, before "packer" insert --dual--.

Signed and Sealed this
Eighteenth Day of June, 1991

*Attest:*

*Attesting Officer*

HARRY F. MANBECK, JR.

*Commissioner of Patents and Trademarks*